US005536423A

United States Patent [19]

Miyagawa et al.

[11] Patent Number: 5,536,423

[45] Date of Patent: Jul. 16, 1996

[54] HYDRAULIC WORKING OIL COMPOSITION FOR BUFFERS

[75] Inventors: Toru Miyagawa; Mitsuo Okada, both of Yokohama, Japan

[73] Assignee: Nippon Oil Co., Ltd., Tokyo, Japan

[21] Appl. No.: 385,348

[22] Filed: Feb. 8, 1995

[30] Foreign Application Priority Data

Feb. 14, 1994 [JP] Japan ..... 6-037528

[51] Int. Cl.[6] ..... C10M 137/08; C10M 133/00

[52] U.S. Cl. ..... 508/436; 508/437; 508/253; 508/334; 508/282

[58] Field of Search ..... 252/32.5, 34

[56] References Cited

U.S. PATENT DOCUMENTS

| | | | |
|---|---|---|---|
| 3,779,928 | 12/1973 | Schlicht | 252/32.5 |
| 3,979,308 | 9/1976 | Mead et al. | 252/32.5 |
| 4,511,482 | 4/1985 | Horodysky | 252/34 |
| 4,537,694 | 8/1985 | Horodysky | 252/34 |
| 4,847,457 | 7/1989 | Wirth et al. | 252/32.5 |
| 5,342,531 | 8/1994 | Walters et al. | 252/32.5 |
| 5,354,484 | 10/1994 | Schwind et al. | 252/32.5 |

*Primary Examiner*—Ellen M. McAvoy
*Attorney, Agent, or Firm*—Bucknam and Archer

[57] ABSTRACT

A hydraulic working oil composition for buffers which comprises:

a lubricating oil as a base oil, (A) at least one phosphorus-containing compound selected from the group consisting of a phosphoric acid ester having a specific structure, a phosphorous acid ester having a specific structure and a salt of-the phosphoric acid ester and/or the phosphorous acid ester with an aliphatic monoamine having 8–22 carbon atoms, and (B) at least one nitrogen-containing compound selected from the group consisting of an aliphatic polyamine having a specific structure and a salt of the aliphatic polyamine with an aliphatic acid having 6 carbon atoms, the compounds (A) and (B) being essential components added to said base oil.

33 Claims, No Drawings

HYDRAULIC WORKING OIL COMPOSITION FOR BUFFERS

BACKGROUND OF THE INVENTION

1. Field of the Invention

This invention relates to hydraulic working oil compositions for use in buffers and more particularly to such oil compositions suitable for use in car suspension devices such as shock absorbers, active suspensions, stay dampers and engine dampers.

2. Prior Art

As conventional hydraulic working oils which have hitherto been used in car buffer devices such as shock absorbers, active suspensions, stay dampers and engine dampers, those incorporated with a phosphoric acid ester and/or a phosphorus acid ester to provide the car buffer devices with friction-reducing properties and wear-preventing properties are known. In addition, there have also widely been used such hydraulic working oils in which are additionally used oily agents such as a fatty acid, aliphatic alcohol and fatty acid ester to further improve the working oils in friction-reducing properties.

Hydraulic working oils are those which are required to be capable of reducing friction at friction surfaces simultaneously this preventing wear of the friction surfaces. Recently, there have been increasingly used bush members impregnated with a Teflon resin in an attempt to reduce friction at friction surfaces by having resort to such material or substance as above. Further, gas-sealed type and damping force-variable type buffers have particularly been increasingly used and, therefore, the load applied to the friction surfaces of the buffers has been increased whereby conditions under which the buffers are used have come to be severe.

Consequently, Japanese Patent Application Gazette No. Hei 5-255683 (No. 255683/93) discloses a composition comprising a base oil which contains therein a phosphorus-containing compound such as a phosphoric acid ester or phosphorous acid ester and $C_{12}$-diethanol amine, as an hydraulic working oil exhibiting excellent wear resistance and friction characteristics even under severe conditions.

With a change in such conditions or circumstances under which hydraulic working oils are used, conventional such oils incorporated only with a phosphoric acid ester and/or a phosphorous acid ester, or those in which, in addition to said acid ester or esters, a fatty acid, aliphatic alcohol, a fatty acid ester and other oily agents are used, have raised problems that they will exhibit low and friction-reducing performace.

The development of novel hydraulic working oils for a buffer which meets new requirements such as excellent durability (little degradation due to their use with the lapse of time), friction-reducing effect, in addition to the conventional requirements, since the new requirements have become serious and there has become a substantial need.

SUMMARY OF THE INVENTION

The primary object of this invention is to provide hydraulic working oil compositions for a buffer which are excellent in durability (little degradation due to their use with the lapse of time) and friction-reducing effect.

The present inventors made intensive studies to achieve the above object of this invention and, as the result of their studies, found that the combined use of (A) a phosphorus-containing compound having a specific structure and (B) a nitrogen-containing compound having a specific structure in a lubricating oil as a base oil will exert their synergistic effect thereby to obtain a new hydraulic working oil exhibiting excellent performance when used, thus completing this invention.

The primary object of this invention is achieved by providing a hydraulic working oil composition prepared by adding to a lubricating oil as a base oil the following ingredients as essential components (A) at least one phosphorus-containing compound selected from the group consisting of the following components (a) to (c):

(a) a phosphoric acid ester represented by the following general formula (1)

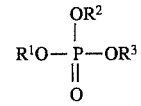

(1)

(b) a phosphorous acid ester represented by the following general formula (2)

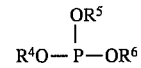

(2)

(c) a salt of the phosphoric acid ester (a) and/or the phosphorous acid ester (b) with an aliphatic monoamine having 8–22 carbon atoms, wherein in the formulae (1) and (2) $R^1$ and $R^4$ are each an alkyl or alkenyl group having 4–22 carbon atoms, or are each an aryl group or an alkylaryl or arylalkyl group each having 6–22 carbon atoms; $R^2$ and $R^3$, and $R^5$ and $R^6$, may be identical with, or different from, each other, respectively, and these $R^2$, $R^3$, $R^5$ and $R^6$ are each hydrogen, an alkyl or alkenyl group having 1–22 carbon atoms or are each an aryl group or an alkylaryl or arylalkyl group each having 6–22 carbon atoms, (B) at least one kind of a nitrogen-containing compound selected from the following compounds (d) and (e):

(d) an aliphatic polyamine represented by the following general formula (3)

$$R^7\text{-}(NH-R^8)_a\text{-}NH_2 \quad (3)$$

wherein $R^7$ is an alkyl or alkenyl group having 6–22 carbon atoms, $R^8$ is an alkylene group having 2–4 carbon atoms and a is an integer of 1 to 4

(e) a salt of the aliphatic polyamine (d) with an aliphatic acid having 6–22 carbon atoms.

This invention will be explained below in more detail.

The lubricating oils used as a base oil in this invention are not particularly limited, and both mineral oils and synthetic oils which are usually used as a base oil for lubricating oils may be used in this invention.

The mineral oil-type lubricating oils which may be used as a base oil, include paraffinic and naphthenic oils obtained by refining, for example, lubricating oil fractions obtained by the atmospheric and reduced-pressure distillation of a crude oil, by means of a suitable combination of solvent deasphalting, solvent extraction, hydrocracking, solvent dewaxing, catalytic dewaxing, hydrorefining, sulfuric acid washing, clay treatment, and the like.

The synthetic oil-type lubricating oils which may be used as a base oil, include poly α-olefins (polybutene, 1-octene oligomers, 1-decene oligomers, etc.), alkylbenzenes, alkylnaphthalenes, diesters (ditridecyl glutarate, di-2-ethylhexyl adipate, diisodecyl adipate, ditridecyl adipate, di-2-ethylhexyl sebacate, etc.), polyol esters (trimethylolpropane caprylate, trimethylolpropane peralgonate, pentaerithritol 2-ethyl hexanoate, pentaerithritol peralgonate, etc.), polyoxyalkylene glycol, polyphenyl ethers, silicone oil and perfluoroalkyl ethers.

The lubricating oils used as a base oil are hereinafter sometimes referred to as "base lubricating oils" for simplicity.

The base lubricating oils may be used singly or jointly, but the mineral oil-type base lubricating oils are preferably used from the standpoint of their adaptability to, or compatibility with, gum sealants in this invention.

The base lubricating oils used in this invention are optional in viscosity, but those having a viscosity of 8–60 cSt, preferably 10–40 cSt, at 40° C. are usually used from necessity for their applicability to damping force required in general buffers.

The component (A) which is an essential additive to be added to a base lubricating oil according to this invention is at least one phosphorus-containing compound selected from the group consisting of (a) a phosphoric acid ester represented by the following general formula (1), (b) a phosphorous acid ester represented by the following general formula (2) and (c) a salt of the phosphoric acid ester (a) and/or the phosphorous acid ester (b) with an aliphatic monoamine having 8–22 carbon atoms:

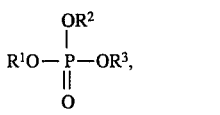

(1)

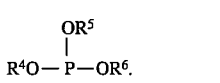

(2)

In these formulae (1) and (2), $R^1$ and $R^4$ are each a straight-chain or branched-chain alkyl or alkenyl group having 4–22 carbon atoms, or are each an aryl group or an alkylaryl or arylalkyl group having a straight-chain or branched-chain alkyl group, the aryl, alkylaryl and arylalkyl groups each having 6–22 carbon atoms; $R^2$ and $R^3$, and $R^5$ and $R^6$, may be identical with, or different from, each other, respectively, and these $R^2$, $R^3$, $R^5$ and $R^6$ are each a straight-chain or branched-chain alkyl or alkenyl group having 1–22 carbon atoms, or are each an aryl group or an alkylaryl or arylalkyl group each having 6–22 carbon atoms, the alkyl group in these alkylaryl and arylalkyl groups being a straight-chain or branched-chain alkyl group.

The $R^1$ and $R^4$ each include an alkyl group such as butyl groups (including all isomeric groups), pentyl groups (including all isomeric groups), hexyl groups (including all isomeric groups), heptyl groups (including all isomeric groups), octyl groups (including all isomeric groups), nonyl groups (including all isomeric groups), decyl groups (including all isomeric groups), undecyl groups (including all isomeric groups), dodecyl groups (including all isomeric groups), tridecyl groups (including all isomeric groups), tetradecyl groups (including all isomeric groups), pentadecyl groups (including all isomeric groups), hexadecyl groups (including all isomeric groups), heptadecyl groups (including all isomeric groups), octadecyl groups (including all isomeric groups), nonadecyl groups (including all isomeric groups), eicosyl groups (including all isomeric groups), heneicosyl groups (including all isomeric groups) and docosyl groups (including all isomeric groups); an alkenyl group such as butenyl groups (including all isomeric groups), pantenyl groups (including all isomeric groups), hexenyl groups (including all isomeric groups), heptenyl groups (including all isomeric groups), octenyl groups (including all isomeric groups), nonenyl groups (including all isomeric groups), decenyl groups (including all isomeric groups), undecenyl groups (including all isomeric groups), dodecenyl groups (including all isomeric groups), tridecenyl groups (including all isomeric groups), tetradecenyl groups (including all isomeric groups), pentadecenyl groups (including all isomeric groups), hexadecenyl groups (including all isomeric groups), heptadecenyl groups (including all isomeric groups), octadecenyl groups (including all isomeric groups), nonadecenyl groups (including all isomeric groups), eicosenyl groups (including all isomeric groups), heneicosenyl groups (including all isomeric groups) and docosenyl groups (including all isomeric groups); an aryl group such as a phenyl group and naphtyl groups (including all isomeric groups); an alkylaryl group such as tolyl groups (including all isomeric groups), ethylphenyl groups (including all isomeric groups), propylphenyl groups (including all isomeric groups), butylphenyl groups (including all isomeric groups), pentylphenyl groups (including all isomeric groups) hexylphenyl groups (including all isomeric groups) heptylphenyl groups (including all isomeric groups) octylphenyl groups (including all isomeric groups) nonylphenyl groups (including all isomeric groups) decylphenyl groups (including all isomeric groups) undecylphenyl groups (including all isomeric groups) dodecylphenyl groups (including all isomeric groups) tridecylphenyl groups (including all isomeric groups), tetradecylphenyl groups (including all isomeric groups), pentadecylphenyl groups (including all isomeric groups), hexadecylphenyl groups (including all isomeric groups), xylyl groups (including all isomeric groups), ethylmethylphenyl groups (including all isomeric groups), diethylphenyl groups (including all isomeric groups), dipropylphenyl groups (including all isomeric groups), dibutylphenyl groups (including all isomeric groups), methylnaphtyl groups (including all isomeric groups), ethylnaphtyl groups (including all isomeric groups), propylnaphtyl groups (including all isomeric groups), butylnaphtyl groups (including all isomeric groups), dimethylnaphtyl groups (including all isomeric groups), ethylmethylnaphtyl groups (including all isomeric groups), diethylnaphtyl groups (including all isomeric groups), dipropylnaphtyl groups (including all isomeric groups) and dibutylnaphtyl groups (including all isomeric groups); an arylalkyl group such as a benzyl group, phenylethyl groups (including all isomeric groups) and phenylpropyl groups (including all isomeric groups).

On the other hand, each of the $R^2$ and $R^3$, and the $R^5$ and $R^6$, includes hydrogen, an alkyl group such as methyl group, ethyl group, propyl groups (including all isomeric groups), butyl groups (including all isomeric groups), pentyl groups (including all isomeric groups), hexyl groups (including all isomeric groups), heptyl groups (including all isomeric groups), octyl groups (including all isomeric groups), nonyl groups (including all isomeric groups), decyl groups (including all isomeric groups), undecyl groups (including all isomeric groups), dodecyl groups (including all isomeric groups), tridecyl groups (including all isomeric groups), tetradecyl groups (including all isomeric groups), pentadecyl groups (including all isomeric groups), hexadecyl groups (including all isomeric groups), heptadecyl groups (including all isomeric groups), octadecyl groups (including all isomeric groups), nonadecyl groups (including all isomeric groups), eicosyl groups (including all isomeric groups), heneicosyl groups (including all isomeric groups) and docosyl groups (including all isomeric groups); an alkenyl group such as butenyl groups (including all isomeric groups), pentenyl groups (including all isomeric groups), hexenyl groups (including all isomeric groups), heptenyl groups (including all isomeric groups), octenyl groups (including all isomeric groups), nonenyl groups (including all isomeric groups), decenyl groups (including all isomeric groups), undecenyl groups (including all isomeric groups), dodecenyl groups (including all isomeric groups), tridecenyl groups (including all isomeric groups), tetradecenyl groups (including all isomerlc groups), pentadecenyl groups (including all isomeric groups), hexadecenyl groups (including all isomeric groups), heptadecenyl groups (including all isomeric groups), octadecenyl groups (including all isomeric groups), nonadecenyl groups (including all isomeric groups), eicosenyl groups (including all isomeric groups), heneicosenyl groups (including all isomeric groups) and docosenyl groups (including all isomeric groups); an aryl group such as a phenyl group and naphtyl groups (including all isomeric groups); an alkylaryl group such as tolyl groups (including all isomeric groups), ethylphenyl groups (including all isomeric groups), propylphenyl groups (including all isomeric groups), butylphenyl groups (including all isomeric groups), pentylphenyl groups (including all isomeric groups), hexylphenyl groups (including all isomeric groups), heptylphenyl groups (including all isomeric groups), octylphenyl groups (including all isomeric groups), nonylphenyl groups (including all isomeric groups), decylphenyl groups (including all isomeric groups), undecylphenyl groups (including all isomeric groups), dodecylphenyl groups (including all isomeric groups), tridecylphenyl groups (including all isomeric groups), tetradecylphenyl groups (including all isomeric groups), pentadecylphenyl groups (including all isomeric groups), hexadecylphenyl groups (including all isomeric groups), xylyl groups (including all isomeric groups), ethylmethylphenyl groups (including all isomeric groups), diethylphenyl groups (including all isomeric groups), dipropylphenyl groups (including all isomeric groups), dibutylphenyl groups (including all isomeric groups), methylnaphtyl groups (including all isomeric groups), ethylnaphtyl groups (including all isomeric groups), propylnaphtyl groups (including all isomeric groups), butylnaphtyl groups (including all isomeric groups), dimethylnaphtyl groups (including all isomeric groups), ethylmethylnaphtyl groups (including all isomeric groups), diethylnaphtyl groups (including all isomeric groups), dipropylnaphtyl groups (including all isomeric groups) and dibutylnaphtyl groups (including all isomeric groups); an arylalkyl group such as benzyl groups phenylethyl groups (including all isomeric groups) and phenylpropyl groups (including all isomeric groups).

From the standpoint of its excellency particularly in wear-preventing and friction-reducing effects, the preferable phosphoric acid ester of the component (a) used in this invention is a diester compound of the formula (1) wherein $R^1$ and $R^2$ are each a member selected from a straight-chain or branched-chain alkyl or alkenyl group having 6 to 20 carbon atoms and a monoalkylphenyl group having 14–20 carbon atoms in which the alkyl is a straight-chain or branched-chain one, and $R^3$ is hydrogen. The preferable phosphoric acid ester is a diester compound of the formula (1) wherein $R^1$ and $R^2$ are each a member selected from a straight-chain or branched-chain alkyl or alkenyl group having 8 to 18 carbon atoms, and $R^3$ is hydrogen.

The preferable phosphoric acid diesters (a) include dioctyl acid phosphates (including all isomers), didecyl acid phosphates (including all isomers), didodecyl acid phosphates (including all isomers), ditetradecyl acid phosphates (including all isomers), dihexadecyl acid phosphate (including all isomers), dioctadecyl acid phosphates (including all isomers), dioctadecenyl acid phosphates (including all isomers) and mixtures thereof.

In the same manner as in the phosphoric acid ester of the formula (1), from the standpoint of its excellency particularly in wear-preventing and friction-reducing effects the preferable phosphorous acid ester of the component (b) used in this invention is a diester compound of the formula (2) wherein $R^4$ and $R^5$ are each a member selected from a straight-chain or branched-chain alkyl or alkenyl group having 6 to 20 carbon atoms and a monoalkylphenyl group having 14–20 carbon atoms in which .the alkyl is a straight-chain or branched-chain one, and $R^6$ is hydrogen. The preferable phosphorous acid ester is a diester compound of the formula (2) wherein $R^4$ and $R^5$ are each a straight-chain alkyl or alkenyl group having 8 to 18 carbon atoms, and $R^6$ is hydrogen.

The preferable phosphorous acid diesters (b) include dioctyl hydrogen phosphites (including all isomers), didecyl hydrogen phosphites (including all isomers), didodecyl hydrogen phosphites (including all isomers), ditetradecyl hydrogen phosphites (including all isomers), dihexadecyl hydrogen phosphites (including all isomers), dioctadecyl hydrogen phosphites (including all isomers), dioctadecenyl hydrogen phosphites (including all isomers) and mixtures thereof.

The component (c) used in the present invention is a salt of (a) a phosphoric acid ester and/or (b) a phosphorous acid ester with an aliphatic monoamine having 8–22 carbon atoms.

The aliphatic monoamine having 8–22 carbon atoms to be used in forming said salt may be a straight-chain amine or branched-chain amine and a saturated amine or unsaturated amine. Among them, the aliphatic monoamines of straight chain having 12–18 carbon atoms are preferably used.

The preferable aliphatic monoamines include, dodecyl amine (lauryl amine), tetradecyl amine (myristyl amine), hexadecyl amine (cetyl amine), octadecyl amine (stearyl amine), octadecenyl amine (oleyl amine), tallow amine, hardened tallow amine, coconut amine, soybean amine and a mixture thereof.

The component (c) which is particularly preferably used in the present invention, includes a salt of at least one kind of a diester with at least one kind of aliphatic monoamine. Said diester is a member selected from the group consisting of a phosphoric acid diester such as dioctyl acid phosphates (including all isomers), didecyl acid phosphates (including all isomers), didodecyl acid phosphates (including all isomers), ditetradecyl acid phosphates (including all isomers), dihexadecyl acid phosphates (including all isomers), dioctadecyl acid phosphates (including all isomers) and dioctadecenyl acid phosphates (including all isomers), and a phosphorous acid diester such as dioctyl hydrogen phosphites (including all isomers), didecyl hydrogen phosphites (including all isomers), didodecyl hydrogen phosphites (including all isomers), ditetradecyl hydrogen phosphites (including all isomers), dihexadecyl hydrogen phosphites (including all isomers), dioctadecyl hydrogen phosphites (including all isomers) and dioctadecenyl hydrogen phosphites (including all isomers). Said aliphatic monoamine is a member selected from the group consisting of dodecyl amine (lauryl amine), tetradecyl amine (myristyl amine), hexadecyl amine (cetyl amine), octadecyl amine (stearyl amine), octadecenyl amine (oleyl amine), tallow amine, hardened tallow amine, coconut amine and soybean amine and the like.

Furthermore, the salt which is obtained by reacting one mole of the above aliphatic monoamine with one mole of the above phosphoric acid diester and/or phosphorous acid diester is preferably used and includes dioctylphosphate-monolaurylamine salt, dioctylphosphate-monomyristylamine salt, dioctylphosphate-monocetylamine salt, dioctylphosphate-monostearylamine salt, dioctylphosphate-monoleylamine salt, dioctylphosphate-monotallow amine salt, dioctylphosphate-monohardened tallow amine salt, dioctylphosphate-monococonut amine salt, dioctylphosphate-monosoybean amine salt, didecylphosphate-monolaurylamine salt, didecylphosphate-monomyristylamine salt, didecylphosphate-monocetylamine salt, didecylphosphate-monostearylamine salt, didecylphosphate-monoleylamine salt, didecylphosphate-monotallow amine salt, didecylphosphate-monohardened tallow amine salt, didecylphosphate-monococonut amine salt, didecylphosphate-monosoybean amine salt, didodecylphosphate-monolaurylamine salt, didodecylphosphate-monomyristylamine salt, didodecylphosphate-monocetylamine salt, didodecylphosphate-monostearylamine salt, didodecylphosphate-monoleylamine salt, didodecylphosphate-monotallow amine salt, didodecylphosphate-monohardened tallow amine salt, didodecylphosphate-monococonut amine salt, didodecylphosphate-monosoybean amine salt, ditetradecylphosphate-monolaurylamine salt, ditetradecylphosphate-monomyristylamine salt, ditetradecylphosphate-monocetylamine salt, ditetradecylphosphate-monostearylamine salt, ditetradecylphosphate-monoleylamine salt, ditetradecylphosphate-monotallow amine salt, ditetradecylphosphate-monohardened tallow amine salt, ditetradecylphosphate-monococonut amine salt, ditetradecylphosphate-monohardened soybean amine salt, dihexadecylphosphate-monolaurylamine salt, dihexadecylphosphate-monomyristylamine salt, dihexadecylphosphate-monocetylamine salt, dihexadecylphosphate-monostearylamine salt, dihexadecylphosphate-monoleylamine salt, dihexadecylphosphate-monotallow amine salt, dihexadecylphosphate-monohardened tallow amine salt, dihexadecylphosphate-monococonut amine salt, dihexadecylphosphate-monohardened soybean amine salt, dioctadecylphosphate-monolaurylamine salt, dioctadecylphosphate-monomyristylamine salt, dioctadecylphosphate-monocetylamine salt, dioctadecylphosphate-monostearylamine salt, dioctadecylphosphate-monoleylamine salt, dioctadecylphosphate-monotallow amine salt, dioctadecylphosphate-monohardened tallow amine salt, dioctadecylphosphate-monococonut amine salt, dioctadecylphosphate-monohardened soybean amine salt, dioctadecenylphosphate-monolaurylamine salt, dioctadecenylphosphate-monomyristylamine salt, dioctadecenylphosphate-monocetylamine salt, dioctadecenylphosphate-monostearylamine salt, dioctadecenylphosphate-monoleylamine salt, dioctadecenylphosphate-monotallow amine salt, dioctadecenylphosphate-monohardened tallow amine salt, dioctadecenylphosphate-monococonut amine salt, dioctadecenylphosphate-monohardened soybean amine salt, dioctylphosphite-monolaurylamine salt, dioctylphosphite-monomyristylamine salt, dioctylphosphite-monocetylamine salt, dioctylphosphite-monostearylamine salt, dioctylphosphite-monoleylamine salt, dioctylphosphite-monotallow amine salt, dioctylphosphite-monohardened tallow amine salt, dioctylphosphite-monococonut amine salt, dioctylphosphite-monohardened soybean amine salt, didecylphosphite-monolaurylamine salt, didecylphosphite-monomyristylamine salt, didecylphosphite-monocetylamine salt, didecylphosphite-monostearylamine salt, didecylphosphite-monoleylamine salt, didecylphosphite-monotallow amine salt, didecylphosphite-monohardened tallow amine salt, didecylphosphite-monococonut amine salt, didecylphosphite-monosoybean amine salt, didodecylphosphite-monolaurylamine salt, didodecylphosphite-monomyristylamine salt, didodecylphosphite-monocetylamine salt, didodecylphosphite-monostearylamine salt, didodecylphosphite-monoleylamine salt, didodecylphosphite-monotallow amine salt, didodecylphosphite-monohardened tallow amine salt, didodecylphosphite-monococonut amine salt, didodecylphosphite-monosoybean amine salt, ditetradecylphosphite-monolaurylamine salt, ditetradecylphosphite-monomyristylamine salt, ditetradecylphosphite-monocetylamine salt, ditetradecylphosphite-monostearylamine salt, ditetradecylphosphite-monoleylamine salt, ditetradecylphosphite-monotallow amine salt, ditetradecylphosphite-monohardened tallow amine salt, ditetradecylphosphite-monococonut amine salt, ditetradecylphosphite-monohardened soybean amine salt, dihexadecylphosphite-monolaurylamine salt, dihexadecylphosphite-monomyristylamine salt, dihexadecylphosphite-monocetylamine salt, dihexadecylphosphite-monostearylamine salt, dihexadecylphosphite-monoleylamine salt, dihexadecylphosphite-monotallow amine salt, dihexadecylphosphite-monohardened tallow amine salt, dihexadecylphosphite-monococonut amine salt, dihexadecylphosphite-monohardened soybean amine salt, dioctadecylphosphite-monolaurylamine salt, dioctadecylphosphite-monomyristylamine salt, dioctadecylphosphite-monocetylamine salt, dioctadecylphosphite-monostearylamine salt, dioctadecylphosphite-monoleylamine salt, dioctadecylphosphite-monotallow amine salt, dioctadecylphosphite-monohardened tallow amine salt, dioctadecylphosphite-monococonut amine salt, dioctadecylphosphite-monohardened soybean amine salt, dioctadecenylphosphite-monolaurylamine salt, dioctadecenylphosphite-monomyristylamine salt, dioctadecenylphosphite-monocetylamine salt, dioctadecenylphosphite-monostearylamine salt, dioctadecenylphosphite-monoleylamine salt, dioctadecenylphosphite-monotallow amine salt, dioctadecenylphosphite-monohardened tallow amine salt, dioctadecenylphosphite-monococonut amine salt, dioctadecenylphosphite-monohardened soybean amine salt and a mixture thereof.

In the hydraulic working oil composition for buffers of this invention, the component (A) may be added in an arbitrary amount, but it is usually added in an amount of preferably 0.05 to 10% by weight, more preferably 0.1 to 5% by weight, based on the total weight of the composition.

Further, the component (B) used as another essential additive in the present invention is at least one kind of a nitrogen-containing compound selected from an aliphatic polyamine (d) represented by the following general formula (3)

$$R^7\text{-}(NH-R^8)_a\text{-}NH_2 \quad (3)$$

and a salt (e) of the aliphatic polyamine (d) with an aliphatic acid having 8–22 carbon atoms.

In the above formula (3), $R^7$ is a straight-chain or branched-chain alkyl or alkenyl group having 6–22 carbon atoms, $R^8$ is a straight-chain or branched-chain alkylene group having 2–4 carbon atoms, and a is an integer of 1 to 4.

The $R^7$ is exemplified by an alkyl group such as hexyl groups (including all isomeric group), heptyl groups (including all isomeric group), octyl groups (including all isomeric group), nonyl groups (including all isomeric group), decyl groups (including all isomeric group), undecyl groups (including all isomeric group), dodecyl groups (including all isomeric group), tridecyl groups (including all isomeric group), tetradecyl groups (including all isomeric group), pentadecyl groups (including all isomeric group), hexadecyl groups (including all isomeric group), heptadecyl groups (including all isomeric group), octadecyl groups (including all isomeric group), nonadecyl groups (including all isomeric group), eicosyl groups (including all isomeric group), heneicosyl groups (including all isomeric group) and docosyl groups (including all isomeric group); and an alkenyl group such as octenyl groups (including all isomeric group), nonenyl groups (including all isomeric group), decenyl groups (including all isomeric group), undecenyl groups (including all isomeric group), docenyl groups (including all isomeric group), tridecenyl groups (including all isomeric group), tetradecenyl groups (including all isomeric group), pentadecenyl groups (including all isomeric group), hexadecenyl groups (including all isomeric group), peptadecenyl groups (including all isomeric group), octadecenyl groups (including all isomeric group), nonadecenyl groups (including all isomeric group), eicosenyl groups (including all isomeric group), heneicosenyl groups (including all isomeric group) and docosenyl groups (including all isomeric group); and an aliphatic group derived from fats and oils such as tallow, hardened tallow, coconut oil and soybean oil. The $R^6$ includes an ethylene group, trimethylene group, 1-methylethylene group, 2-methylethylene group, tetramethylene group, 1-methyltrimethylene group, 2-methyltrimethylene group, 3-methyltrimethylene group, 1-ethylethylene group, 2-ethylethylene group, 1,1-dimethylethylene group, 1,2-dimethylethylene group and 2,2-dimethylethylene group.

The aliphatic polyamine (d), which is represented by formula (3) and is among the components (B) used in this invention, is preferably a specified compound of the formula (3) in which $R^7$ is a straight-chain alkyl or alkenyl group having 8–18 carbon atoms, and $R^8$ is an ethylene group or propylene group and a is an integer of 1, in view of the excellent wear-reducing performance of said specified compound.

In the component (B) used in the present invention, particularly preferable compounds as the above aliphatic polyamine (d) represented by the formula (3) include an aliphatic polyamine such as octyl ethylenediamine, octyl propylenediamine, decyl ethylenediamine, decyl propylenediamine, dodecyl ethylenediamine (lauryl ethylenediamine), dodecyl propylenediamine (lauryl propylenediamine), tetradecyl ethylenediamine (myristyl ethylenediamine), tetradecyl propylenediamine (myristyl propylenediamine), hexadecyl ethylenediamine (cetyl ethylenediamine), hexadecyl propylenediamine (cetyl propylenediamine), octadecyl ethylenediamine (stearyl ethylenediamine), octadecyl propylenediamine (stearyl propylenediamine), octadecenyl ethylenediamine (oleyl ethylenediamine), octadecenyl propylenediamine (oleyl propylenediamine), tallow ethylenediamine, tallow propylenediamine, hardened tallow ethylenediamine, hardened tallow propylenediamine, coconut ethylenediamine, coconut propylenediamine, soybean ethylenediamine, soybean propylenediamine and a mixure thereof.

The component (e), which is among the components (B) used in the present invention, is a salt of the aliphatic polyamine (d) with an aliphatic acid having 6–22 carbon atoms.

The aliphatic acid having 6–22 carbon atoms to be used in forming the salt may be a straight-chain or branched-chain one, and may be a saturated or unsaturated one. Among them, the straight-chain aliphatic acids having 8–18 carbon atoms are preferably used.

The preferable aliphatic acids include octanoic acid (caprylic acid), decanoic acid (capric acid), dodecanoic acid (lauric acid), tetradecanoic acid (myristic acid), hexadecanoic acid (palmitic acid), octadecanoic acid (stearic acid), octadecenoic acid (oleic acid), and tallow aliphatic acid, hardened tallow aliphatic acid, coconut oil aliphatic acid, soybean oil aliphatic acid and a mixture thereof.

The particularly preferable component (e) which is among the components (B) according to the present invention, includes a salt of at least one kind of an aliphatic polyamine with at least one kind of an aliphatic acid. Said aliphatic polyamine is a member selected from the group consisting of octyl ethylenediamine, octyl propylenediamine, decyl ethylenediamine, decyl propylenediamine, dodecyl ethylenediamine (lauryl ethylenediamine), dodecyl propylenediamine (lauryl propylenediamine), tetradecyl ethylenediamine (myristyl ethylenediamine), tetradecyl propylenediamine (myristyl propylenediamine), hexadecyl ethylenediamine (cetyl ethylenediamine), hexadecyl propylenediamine (cetyl propylenediamine), octadecyl ethylenediamine (stearyl ethylenediamine), octadecyl propylenediamine (stearyl propylenediamine), octadecenyl ethylenediamine (oleyl ethylenediamine), octadecenyl propylenediamine (oleyl propylenediamine), tallow ethylenediamine, tallow propylenediamine, hardened tallow ethylenediamine, hardened tallow propylenediamine, coconut ethylenediamine, coconut propylenediamine, soybean ethylenediamine, soybean propylenediamine and the like. The aliphatic acid is a member selected from the group consisting of octanoic acid (caprylic acid), decanoic acid (captic acid), dodecanoic acid (lauric acid), tetradecanoic acid (myristic acid), hexadecanoic acid (palmitic acid), octadecanoic acid (stearic acid), 9-octadecenic acid (oleic acid), tallow aliphatic acid, hardened tallow aliphatic acid, coconut oil aliphatic acid, soybean oil aliphatic acid and the like.

Furthermore, there is preferably used a salt in which one aliphatic acid per nitrogen atom in the aliphatic polyamine has been reacted with the aliphatic polyamine (the salt being obtainable by reacting said acid with polyamine in equivalent amounts). The salt includes octyl ethylenediamine-dilaurate, octyl ethylenediamine-dimyristate, octyl ethylenediamine-dipalmitate, octyl ethylenediamine-distearate, octyl ethylenediamine-dioleate, octyl ethylenediamine-ditallow aliphatic acid salt, octyl ethylenediamine-dihardened tallow aliphatic acid salt, octyl ethylenediamine-dicoconut aliphatic acid salt, octyl ethylenediamine-disoybean aliphatic acid salt; octyl propylenediamine-dilaurate, octyl propylenediamine-dimyristate, octyl propylenediamine-dipalmitate, octyl propylenediamine-distearate, octyl propylenediamine-dioleate, octyl propylenediamine-ditallow aliphatic acid salt, octyl propylenediamine-dihardened tallow aliphatic acid salt, octyl propylenediamine-dicoconut aliphatic acid salt, octyl propylenediamine-disoybean aliphatic acid salt; decyl ethylenediamine-dilaurate, decyl ethylenediamine-dimyristate, decyl ethylenediamine-dipalmitate, decyl ethylenediamine-distearate, decyl ethylenediamine-dioleate, decyl ethylenediamine-ditallow aliphatic acid salt, decyl ethylenediamine-dihardened tallow aliphatic acid salt, decyl ethylenediamine-dicoconut aliphatic acid salt, decyl ethylenediamine-disoybean aliphatic acid salt; decyl propylenediamine-dilaurate, decyl propylenediamine-dimyristate, decyl propylenediamine-dipalmitate, decyl propylenediamine-distearate, decyl propylenediamine-dioleate, decyl propylenediamine-ditallow aliphatic acid salt, decyl propylene diamine-dihardened tallow aliphatic acid salt, decyl propylene diamine-dicoconut aliphatic acid salt, decyl propylene diamine-disoybean aliphatic acid salt; lauryl ethylenediamine-dilaurate, lauryl ethylenediamine-dimyristate, lauryl ethylenediamine-dipalmitate, lauryl ethylenediamine-distearate, lauryl ethylenediamine-dioleate, lauryl ethylenediamine-ditallow aliphatic acid salt, lauryl ethylenediamine-dihardened tallow aliphatic acid salt, lauryl ethylenediamine-dicoconut aliphatic acid salt, lauryl ethylenediamine-disoybean aliphatic acid salt; lauryl propylenediamine-dilaurate, lauryl propylenediamine-dimyristate, lauryl propylenediamine-dipalmitate, lauryl propylenediamine-distearate, lauryl propylenediamine-dioleate, lauryl propylenediamine-ditallow aliphatic acid salt, lauryl propylenediamine-dihardened tallow aliphatic acid salt, lauryl propylenediamine-dicoconut aliphatic acid salt, lauryl propylenediamine-disoybean aliphatic acid salt; myristyl ethylenediamine-dilaurate, myristyl ethylenediamine-dimyristate, myristyl ethylenediamine-dipalmitate, myristyl ethylenediamine-distearate, myristyl ethylenediamine-dioleate, myristyl ethylenediamine-ditallow aliphatic acid salt, myristyl ethylenediamine-dihardened tallow aliphatic acid salt, myristyl ethylenediamine-dicoconut aliphatic acid salt, myristyl ethylenediamine-disoybean aliphatic acid salt; myristyl propylenediamine-dilaurate, myristyl propylenediamine-dimyristate, myristyl propylenediamine-dipalmitate, myristyl propylenediamine-distearate, myristyl propylenediamine-dioleate, myristyl propylenediamine-ditallow aliphatic acid salt, myristyl propylenediamine-dihardened tallow aliphatic acid salt, myristyl propylenediamine-dicoconut aliphatic acid salt, myristyl propylenediamlne-disoybean aliphatic acid salt; cetyl ethylenediamine-dilaurate, cetyl ethylenediamine-dimyristate, cetyl ethylenediamine-dipalmitate, cetyl ethylenediamine-distearate, cetyl ethylenediamine-dioleate, cetyl ethylenediamine-ditallow aliphatic acid salt, cetyl ethylenediamine-dihardened tallow aliphatic acid salt, cetyl ethylenediamine-dicoconut aliphatic acid salt, cetyl ethylenediamine-disoybean aliphatic acid salt; cetyl propylene diamine-dilaurate, cetyl propylenediamine-dimyristate, cetyl propylenediamine-dipalmitate, cetyl propylenediamine-distearate, cetyl propylenediamine-dioleate, cetyl propylenediamine-ditallow aliphatic acid salt, cetyl propylenediamine-dihardened tallow aliphatic acid salt, cetyl propylenediamine-dicoconut aliphatic acid salt, cetyl propylenediamine-disoybean aliphatic acid salt; stearyl ethylenediamine-dilaurate, stearyl ethylenediamine-dimyristate, stearyl ethylenediamine-dipalmitate, stearyl ethylenediamine-distearate, stearyl ethylenediamine-dioleate, stearyl ethylenediamine-ditallow aliphatic acid salt, stearyl ethylenediamine-dihardened tallow aliphatic acid salt, stearyl ethylenediamine-dicoconut aliphatic acid salt, stearyl ethylenediamine-disoybean aliphatic acid salt; stearyl propylene diamine-dilaurate, stearyl propylenediamine-dimyristate, stearyl propylenediamine-dipalmitate, stearyl propylenediamine-distearate, stearyl propylenediamine-dioleate, stearyl propylenediamine-ditallow aliphatic acid salt, stearyl propylenediamine-dihardened tallow aliphatic acid salt, stearyl propylenediamine-dicoconut aliphatic acid salt, stearyl propylenediamine-disoybean aliphatic acid salt; oleyl ethylenediamine-dilaurate, oleyl ethylenediamine-dimyristate, oleyl ethylenediamine-dipalmitate, oleyl ethylenediamine-distearate, oleyl ethylenediamine-dioleate, oleyl ethylenediamine-ditallow aliphatic acid salt, oleyl ethylenediamine-dihardened tallow aliphatic acid salt, oleyl ethylenediamine-dicoconut aliphatic acid salt, oleyl ethylenediamine-disoybean aliphatic acid salt; oleyl propylene diamine-dilaurate, oleyl propylenediamine-dimyristate, oleyl propylenediamine-dipalmitate, oleyl propylenediamine-distearate, oleyl propylenediamine-dioleate, oleyl propylenediamine-ditallow aliphatic acid salt, oleyl propylenediamine-dihardened tallow aliphatic acid salt, oleyl propylenediamine-dicoconut aliphatic acid salt, oleyl propylenediamine-disoybean aliphatic acid salt; tallow ethylenediamine-dilaurate, tallow ethylenediamine-dimyristate, tallow ethylenediamine-dipalmitate, tallow ethylenediamine-distearate, tallow ethylenediamine-dioleate, tallow ethylenediamine-ditallow aliphatic acid salt, tallow ethylenediamine-dihardened tallow aliphatic acid salt, tallow ethylenediamine-dicoconut aliphatic acid salt, tallow ethylenediamine-disoybean aliphatic acid salt; tallow propylene diamine-dilaurate, tallow propylenediamine-dimyristate, tallow propylenediamine-dipalmitate, tallow propylenediamine-distearate, tallow propylenediamine-dioleate, tallow propylenediamine-ditallow aliphatic acid salt, tallow propylenediamine-dihardened tallow aliphatic acid salt, tallow propylenediamine-dicoconut aliphatic acid salt, tallow propylenediamine-disoybean aliphatic acid salt; hardened tallow ethylenediamine-dilaurate, hardened tallow ethylenediamine-dimyristate, hardened tallow ethylenediamine-dipalmitate, hardened tallow ethylenediamine-distearate, hardened tallow ethylenediamine-dioleate, hardened tallow ethylenediamine-ditallow aliphatic acid salt, hardened tallow ethylenediamine-dihardened tallow aliphatic acid salt, hardened tallow ethylenediamine-dicoconut aliphatic acid salt, hardened tallow ethylenediamine-disoybean aliphatic acid salt; hardened tallow propylenediamine-dilaurate, hardened tallow propylenediamine-dimyristate, hardened tallow propylenediamine-dipalmitate, hardened tallow propylenediamine-distearate, hardened tallow propylenediamine-dioleate, hardened tallow propylenediamine-ditallow aliphatic acid salt, hardened tallow propylenediamine-dihardened tallow aliphatic acid salt, hardened tallow propylenediamine-dicoconut aliphatic acid salt, hardened tallow propylenediamine-disoybean aliphatic acid salt; coconut ethylenediamine-dilaurate, coconut ethylenediamine-dimyristate, tallow ethylenediamine-dipalmitate, coconut ethylenediamine-distearate, coconut ethylenediamine-dioleate, coconut ethylenediamine-ditallow aliphatic acid salt, cococnut ethylenediamine-dihardened tallow aliphatic acid salt, coconut ethylenediamine-dicoconut aliphatic acid salt, coconut ethylenediamine-disoybean aliphatic acid salt; coconut propylenediamine-dilaurate, coconut propylenediamine-dimyristate, coconut propylenediamine-dipalmitate, coconut propylenediamine-distearate, coconut propylenediamine-dioleate, coconut propylenediamine-ditallow aliphatic acid salt, coconut propylenediamine-dihardened tallow aliphatic acid salt, coconut propylenediamine-dicoconut aliphatic acid salt, coconut propylenediamine-disoybean aliphatic acid salt; soybean ethylenediamine-dilaurate, soybean ethylenediamine-dimyristate, soybean ethylenediamine-dipalmitate, soybean ethylenediamine-distearate, soybean ethylenediamine-dioleate, soybean ethylenediamine-ditallow aliphatic acid salt, soybean ethylenediamine-dihardened tallow aliphatic acid salt, soybean ethylenediamine-dicoconut aliphatic acid salt, soybean ethylenediamine-disoybean aliphatic acid salt; soybean propylenediamine-dilaurate, soybean propylenediamine-dimyristate, soybean propylenediamine-dipalmitate, soybean propylenediamine-distearate, soybean propylenediamine-dioleate, soybean propylenediamine-ditallow aliphatic acid salt, soybean propylenediamine-dihardened tallow aliphatic acid salt, soybean propylenediamine-dicoconut aliphatic acid salt, soybean propylenediamine-disoybean aliphatic acid salt and a mixture thereof.

In the hydraulic working oil composition for buffers of this invention, the amount of the component (B) added may be arbitrary, but it is desirable to add the component in an amount of preferably 0.05 to 10%, more preferably 0.1 to 5%, by weight based on the total weight of the composition.

As described above, although the hydraulic working oil composition of this invention having excellent performance can be obtained only by adding the components (A) and (B) to the base lubricating oil, to further enhance the thus obtained hydraulic working oil composition in various performances, heretofore known additives for lubricating oils may be used singly or jointly in the above oil composition.

These additives include friction-reducing agents other than the components of the oil composition of this invention, such as an aliphatic alcohol, aliphatic acid, aliphatic amine and aliphatic amide; anti-oxidants such as phenol-, amine-, sulphur-, zinc dithiophosphate- and phenothiazine-based compounds; extreme-pressure agents such as sulfurized fats and oils, sulfides and zinc dithiophosphate; rust preventives such as petroleum sulfonates and dinonylnaphthalene sulfonate; metal deactivators such as benzotriazole and thiadiazole; metallic detergents such as alkaline earth metal sulfonates, alkaline earth metal phenates, alkaline earth metal salicylates and alkaline earth metal phosphonates; ashless dispersants such as succinic imide, succinic esters and benzyl amine; antifoaming agents such as methylsilicone and fluorosilicone; viscosity index improvers such as polymethacrylate, polyisobutylene and polystyrene; and pour point depressants.

Although the amount of these additives added may be arbitrary, the contents of the antifoaming agent, the viscosity index improver, the metal inactivator and each of the other additives in the oil composition are ordinarily 0.0005–1% by weight, 1–30% by weight, 0.005–1% by weight and 0.1–15% by weight in this order, based on the total amount of the oil composition, respectively.

The process for preparing the hydraulic working oil compositions of this invention is not particularly limited. This process, however, may usually comprise mixing a base lubricating oil with the essential components (A) and (B) as well as with the additives, heating the resulting mixture to 30°–100° C. and then maintaining it at this temperature under agitation for 20 minutes to 5 hours, or may comprise separately heating all the additives (solid additives having beforehand been solved in a small amount of the base lubricating oil) to 30°–100° C., mixing the solution of these additives which has been previously mixed with the essential components (A) and (B), in portions or in full into the base lubricating oil, heated to 20°–80° C. and then maintaining the resulting mixture at 30°–100° C. under agitation for 20 minutes to 5 hours.

DESCRIPTION OF THE PREFERRED EMBODIMENTS

This invention will be better understood by the non-limitative Examples and Comparative Examples.

EXAMPLES 1–6 AND COMPARATIVE EXAMPLES 1–5

In each of the Examples, the ingredients shown in Table 1 were mixed together and the resulting mixture was heated to 50° C. under stirring for two hours thereby to prepare a hydraulic working oil composition of this invention (Examples 1–6). The oil compositions of this invention so prepared were subjected to a duration test using an actual device to evaluate them for their friction-reducing effects and wear-preventing effects.

Comparative hydraulic working oil compositions were prepared by following the procedure of the above Examples except that the component (A) was used singly in the base oil (Comp. Example 1), except that the component (B) was used singly (Comp. Example 2), except that an aliphatic acid was substituted for the component (A) (Comp. Example 3), except that an aliphatic monoamine was substituted for the component (B) (Comp. Example 4) or except that a lauryl diethanolamine was substituted for the component (B) (Comp. Example 5).

The comparative oil compositions so prepared were subjected to the same duration test as above.

Duration Test Using Actual Device

Using two commercially available strut-type shock absorbers, duration tests were made under the following conditions until the end of two million frequency of oscillation application.

| | |
|---|---|
| Temperature of a test oil | 80° C. |
| Amount of a test oil used | 330 ml/one shock absorber |
| Lateral load | 200 kgf |
| Entire amplitude of oscillation applied | 50 mm |
| Velocity of oscillation applied | 0.5 m/s |

Friction-reducing Effects

The shock absorbers were measured for their frictional coefficients at their frictional surfaces at the time of oscillation application frequency of zero (at the initial stage of the duration test) and at the time of oscillation application frequency of two millions (at the time of completion of the duration test), respectively. The frictional coefficients so measured are as shown in Table 1.

As is apparent from the results of the Examples, the hydraulic working oil compositions (Examples 1–6) are excellent in friction-reducing effects at the initial stage of the duration test and exhibit less degradation of their friction-reducing performance with the lapse of time.

The comparative hydraulic working oil compositions (Comp. Examples 1–5), on the other hand, are excellent in friction-reducing effects at the initial stage of the duration test but they exhibit much more degradation of their friction-reducing performances with the lapse of time.

Effects of this Invention

As is apparent from the foregoing, the hydraulic working oil compositions of this invention are excellent in durability of friction-reducing effects at the initial stage of the duration test and exhibit less degradation of their friction-reducing performances with the lapse of time.

TABLE 1

| | | | Ex. 1 | Ex. 2 | Ex. 3 | Ex. 4 | Ex. 5 | Ex. 6 | Comp. Ex. 1 | Comp. Ex. 2 | Comp. Ex. 3 | Comp. Ex. 4 | Comp. Ex. 5 |
|---|---|---|---|---|---|---|---|---|---|---|---|---|---|
| Compo- | base oil | solvent-refined mineral | 94.4 | 94.4 | 94.4 | 94.4 | 94.4 | 94.4 | 94.4 | 94.4 | 94.4 | 94.4 | 94.4 |

TABLE 1-continued

| | | | | Ex. 1 | Ex. 2 | Ex. 3 | Ex. 4 | Ex. 5 | Ex. 6 | Comp. Ex. 1 | Comp. Ex. 2 | Comp. Ex. 3 | Comp. Ex. 4 | Comp. Ex. 5 |
|---|---|---|---|---|---|---|---|---|---|---|---|---|---|---|
| sition | | oil *1 | | | | | | | | | | | | |
| (wt. %) | component | dioleyl acid phosphate | | 1.0 | — | — | 1.0 | — | — | 2.0 | — | 1.0 | 1.0 | 1.0 |
| | (A) | dioleyl hydrogen phosphite | | — | 1.0 | — | — | 1.0 | — | — | — | — | — | — |
| | | di(2-ethylhexyl)acid phosphate · monoleyl amine salt | | — | — | 1.0 | — | — | 1.0 | — | — | — | — | — |
| | component | deyl ethylene diamine | | 0.5 | 0.5 | 0.5 | — | — | — | — | 0.5 | — | — | — |
| | (B) | tallow propylene diamine · dioleic acid salt | | — | — | — | 0.5 | 0.5 | 0.5 | — | — | — | — | — |
| | oleic acid | | | — | — | — | — | — | — | — | — | 0.5 | — | — |
| | oleyl amine | | | — | — | — | — | — | — | — | — | — | 0.5 | — |
| | lauryl diethanol amine *2 | | | — | — | — | — | — | — | — | — | — | — | 0.5 |
| | 2,6-di-t-butyl-p-cresol | | | 0.6 | 0.6 | 0.6 | 0.6 | 0.6 | 0.6 | 0.6 | 0.6 | 0.6 | 0.6 | 0.6 |
| | polymethacrylate | | | 3.5 | 3.5 | 3.5 | 3.5 | 3.5 | 3.5 | 3.5 | 3.5 | 3.5 | 3.5 | 3.5 |
| durability test by real machine *3 | friction-reducing effect | 1 | friction coefficient (at initial condition) | 0.103 | 0.102 | 0.104 | 0.102 | 0.103 | 0.104 | 0.102 | 0.102 | 0.102 | 0.102 | 0.103 |
| | | 2 | friction coefficient (at 200 million times) | 0.135 | 0.140 | 0.148 | 0.132 | 0.142 | 0.152 | 0.208 | 0.224 | 0.217 | 0.217 | 0.206 |
| | | 2/1 | | 1.31 | 1.37 | 1.42 | 1.29 | 1.38 | 1.46 | 2.04 | 2.20 | 2.13 | 2.13 | 2.00 |

*1: kinematic viscosity 10 cSt (at 40° C.)
*2: $C_{12}H_{25}$—$N(C_2H_4OH)_2$
*3: mean value of two shock absorbers (Strut-type)

What is claimed is:

1. A hydraulic working oil composition for buffers which comprises:

a lubricating oil as a base oil, (A) at least one phosphorus-containing compound selected from the group consisting of the following components (a) to (c):

(a) a phosphoric acid ester of formula (1)

$$R^1O-\underset{\underset{O}{\|}}{\overset{\overset{OR^2}{|}}{P}}-OR^3, \quad (1)$$

(b) a phosphorus acid ester of formula (2)

$$R^4O-\overset{\overset{OR^5}{|}}{P}-OR^6 \text{ and} \quad (2)$$

(c) a salt of at least one of said phosphoric acid ester (a) and said phosphorus acid ester (b) with an aliphatic monoamine having 8–22 carbon atoms, wherein $R^1$ and $R^4$ are each an alkyl or alkenyl group having 4–22 carbon atoms, or are each an aryl group or an alkylaryl or arylalkyl group each having 6–22 carbon atoms; $R^2$ and $R^3$, and $R^5$ and $R^6$ are identical with, or different from each other respectively and said $R^2$, $R^3$, $R^5$ and $R^6$ are each hydrogen, an alkyl or alkenyl group having 1–22 carbon atoms, or are each an aryl group or an alkylaryl or arylalkyl group having 6–22 carbon atoms, and (B) at least one nitrogen-containing compound selected from the following components (d) to (e):

(d) an aliphatic polyamine of formula (3)

$$R^7\text{-}(NH-R^8)_a\text{-}NH_2 \quad (3)$$

wherein $R^7$ is an alkyl or alkenyl group having 6–22 carbon atoms, $R^8$ is an alkylene group having 2–4 carbon atoms, a is an integer of 1 to 4, and (e) a salt of said aliphatic polyamine (d) with an aliphatic acid having 6–22 carbon atoms, the compounds (A) and (B) being essential components added to said base oil.

2. The hydraulic working oil composition for buffers according to claim 1, wherein said phosphoric acid ester of said component (a) of formula (1) is a diester compound wherein $R^1$ and $R^2$ are each a member selected from a straight-chain or branched-chain alkyl or alkenyl group having 6–20 carbon atoms and a monoalkylphenyl group having 14–20 carbon atoms in which alkyl is straight-chain or branched-chain and $R^3$ is hydrogen.

3. The hydraulic working oil composition for buffers according to claim 1, wherein said phosphoric acid ester of said component (a) of formula (1) is a diester compound wherein $R^1$ and $R^2$ are each a member selected from a straight-chain or branched-chain alkyl or alkenyl group having 8–18 carbon atoms, and $R^3$ is hydrogen.

4. The hydraulic working oil composition for buffers according to claim 1, wherein said phosphorous acid ester of said component (b) of formula (2) is a diester compound wherein $R^4$ and $R^5$ are each a member selected from a straight-chain or branched-chain alkyl or alkenyl group having 6 to 20 carbon atoms and a monoalkylphenyl group having 14–20 carbon atoms in which the alkyl is straight-chain or branched-chain, and $R^6$ is hydrogen.

5. The hydraulic working oil composition for buffers according to claim 1, wherein said phosphorous acid ester of said component (b) of formula (2) is a diester compound wherein $R^4$ and $R^5$ are each a member selected from a straight-chain or branched-chain alkyl or alkenyl group having 8 to 18 carbon atoms, and $R^6$ is hydrogen.

6. The hydraulic working oil composition for buffers according to claim 1, wherein said aliphatic monoamine of said component (c) is a straight chain aliphatic monoamine having 12–18 carbon atoms.

7. The hydraulic working oil composition for buffers according to claim 1, wherein the amount of said component (A) is 0.05 to 10% by weight, based on the total weight of the composition.

8. The hydraulic working oil composition for buffers according to claim 7, wherein the amount of said component (A) is 0.1 to 5% by weight, based on the total weight of the composition.

9. The hydraulic working oil composition for buffers according to claim 1, wherein said aliphatic polyamine of said component (d) of formula (3) is a compound wherein $R^7$ is a straight-chain or branched-chain alkyl or alkenyl having 8–18 carbon atoms, $R^8$ is ethylene or propylene group, and a is 1.

10. The hydraulic working oil composition for buffers according to claim 1, wherein said aliphatic acid of said component (e) is a straight-chain aliphatic acid having 8–18 carbon atoms.

11. The hydraulic working oil composition for buffers according to claim 1, wherein the amount of said component (B) is 0.05 to 10% by weight, based on the total weight of the composition.

12. The hydraulic working oil composition for buffers according to claim 1, wherein said composition additionally contains at least one additive selected from the group consisting of a friction-reducing agent, an anti-oxidant, an extreme-pressure agent, a rust preventive, a metal deactivator, a metallic detergent, an ashless dispersant, an antifoaming agent, a viscosity index improver and a pour point depressant.

13. The hydraulic working oil composition for buffers according to claim 12, wherein the content of said antifoaming agent, said viscosity index improver, said metal inactivator and each of the other additives in the oil composition is 0.0005–1% by weight, 1–30% by weight, 0.005–1% by weight and 0.1–15% by weight in this order, based on the total amount of the oil composition, respectively.

14. The hydraulic working oil composition for buffers according to claim 12, wherein said friction-reducing agent is an aliphatic alcohol, an aliphatic acid, an aliphatic amine or an aliphatic amide.

15. The hydraulic working oil composition for buffers according to claim 12, wherein said antioxidant is a phenol-, amine-, sulphur-, zinc dithiophosphate- or a phenothiazine-based compound.

16. The hydraulic working oil composition for buffers according to claim 12, wherein said extreme-pressure agent is a sulfurized fat or oil, a sulfide or a zinc dithiophosphate.

17. A hydraulic working oil composition for buffers according to claim 12, wherein said rust preventive agent is a petroleum sulfonate or dinonylnaphthalene sulfonate.

18. The hydraulic working oil composition for buffers according to claim 12, wherein said metal deactivator is a benzotriazole or thiadiazole.

19. The hydraulic working oil composition for buffers according to claim 12, wherein said metallic detergent is an alkaline earth metal sulfonate, an alkaline earth metal phenate, an alkaline earth metal salicylate or an alkaline earth metal phosphonate.

20. The hydraulic working oil composition for buffers according to claim 12, wherein said ashless dispersant is a succinic imide, a succinic ester, or benzylamine.

21. The hydraulic working oil composition for buffers according to claim 12, wherein said antifoaming agent is a methylsilicone or a fluorosilicone.

22. A hydraulic working oil composition for buffers according to claim 12, wherein said viscosity index improver is a polymethacrylate, polyisobutylene or polystyrene.

23. A process for lubricating buffers which comprises:

(I) adding to a lubricating oil as a base oil (A) at least one phosphorus-containing compound selected from the group consisting of the following components (a) to (c):

(a) a phosphoric acid ester of formula (1)

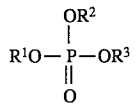

(1)

(b) a phosphorus acid ester of formula (2)

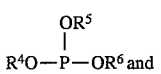

(2)

(c) a salt of at least one of said phosphoric acid ester (a) and said phosphorus acid ester (b) with an aliphatic monoamine having 8–22 carbon atoms, wherein $R^1$ and $R^4$ are each an alkyl or alkenyl group having 4–22 carbon atoms, or are each an aryl group, or an alkylaryl or arylalkyl group each having 6–22 carbon atoms; $R^2$ and $R^3$, and $R^5$ and $R^6$ are identical with, or different from, each other, respectively, and said $R^2$, $R^3$, $R^5$ and $R^6$ are each hydrogen, an alkyl or alkenyl group having 1–22 carbon atoms, or are each an aryl group or an alkylaryl or arylalkyl group having 6–22 carbon atoms, and (B) at least one nitrogen-containing compound selected from the following components (d) to (e):

(d) an aliphatic polyamine of formula (3)

$$R^7\text{-}(NH-R^8)_a\text{-}NH_2 \quad (3)$$

wherein $R^7$ is an alkyl or alkenyl group having 6–22 carbon atoms, $R^8$ is an alkylene group having 2–4 carbon atoms, a is an integer of 1 to 4, and (e) a salt of said aliphatic polyamine (d) with an aliphatic acid having 6–22 carbon atoms whereby a hydraulic working oil composition containing said compounds (A) and (B) is obtained and then (II) adding said working oil composition to said buffers.

24. The process for lubricating buffers according to claim 23, wherein said phosphoric acid ester of said component (a) of formula (1) is a diester compound wherein $R^1$ and $R^2$ are each a member selected from a straight-chain or branched-chain alkyl or alkenyl having 6–20 carbon atoms and a monoalkylphenyl having 14–20 carbon atoms in which alkyl is straight-chain or branched-chain, and $R^3$ is hydrogen.

25. The process for lubricating buffers according to claim 23, wherein said phosphoric acid ester of said component (a) of formula (1) is a diester compound wherein $R^1$ and $R^2$ are each a member selected from a straight-chain or branched-chain alkyl or alkenyl having 8–18 carbon atoms, and $R^3$ is hydrogen.

26. The process for lubricating buffers according to claim 23, wherein said phosphorous acid ester of said component (b) of formula (2) is a diester compound wherein $R^4$ and $R^5$ are each a member selected from a straight-chain or branched-chain alkyl or alkenyl having 6 to 20 carbon atoms and a monoalkylphenyl having 14–20 carbon atoms in which the alkyl is straight-chain or branched-chain, and $R^6$ is hydrogen.

27. The process for lubricating buffers according to claim 23, wherein said phosphorous acid ester of said component (b) of formula (2) is a diester compound wherein $R^4$ and $R^5$ are each a member selected from a straight-chain or branched-chain alkyl or alkenyl group having 8 to 18 carbon atoms, and $R^6$ is hydrogen.

28. The process for lubricating buffers according to claim 23, wherein said aliphatic monoamine of said component (c) is a straight chain aliphatic monoamine having 12–18 carbon atoms.

29. The process for lubricating buffers according to claim 23, wherein the amount of said component (A) is 0.05 to 10% by weight, based on the total weight of the composition.

30. The process for lubricating buffers according to claim 29, wherein the amount of said component (A) is 0.1 to 5% by weight, based on the total weight of the composition.

31. The process for lubricating buffers according to claim 23, wherein said aliphatic polyamine of said component (d) of formula (3) is a compound wherein $R^7$ is a straight-chain or branched-chain alkyl or alkenyl group having 8–18 carbon atoms, $R^8$ is an ethylene or a propylene group, and a is 1.

32. The process for lubricating buffers according to claim 23, wherein said aliphatic acid of said component (e) is a straight-chain aliphatic acid having 8–18 carbon atoms.

33. The process for lubricating buffers according to claim 23, wherein the amount of said component (B) is 0.05 to 10% by weight, based on the total weight of the composition.

* * * * *